US006768475B2

(12) United States Patent
Ohtsuka et al.

(10) Patent No.: US 6,768,475 B2
(45) Date of Patent: Jul. 27, 2004

(54) ANTENNA

(75) Inventors: Masataka Ohtsuka, Tokyo (JP); Isamu Chiba, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/250,520

(22) PCT Filed: Feb. 27, 2001

(86) PCT No.: PCT/JP01/01463

§ 371 (c)(1),
(2), (4) Date: Jul. 3, 2003

(87) PCT Pub. No.: WO02/069450

PCT Pub. Date: Sep. 6, 2002

(65) Prior Publication Data

US 2004/0051678 A1 Mar. 18, 2004

(51) Int. Cl.[7] ..... H01Q 21/00
(52) U.S. Cl. ..... 343/893; 343/895; 343/770
(58) Field of Search ..... 343/893, 895, 343/700 MS, 770, 853; 381/92; 367/905; H01Q 21/00

(56) References Cited

U.S. PATENT DOCUMENTS 5,838,284 A * 11/1998 Dougherty ..... 343/893
6,205,224 B1 * 3/2001 Underbrink ..... 381/92
6,583,768 B1 * 6/2003 Underbrink ..... 343/893
6,646,621 B1 * 11/2003 Phelan et al. ..... 343/895

FOREIGN PATENT DOCUMENTS

| | | |
|---|---|---|
| JP | 52-120653 | 10/1977 |
| JP | 5-14051 A | 1/1993 |
| JP | 6-326510 A | 11/1994 |
| JP | 7-131239 A | 5/1995 |
| JP | 7-288417 A | 10/1995 |

* cited by examiner

*Primary Examiner*—Hoanganh Le
(74) *Attorney, Agent, or Firm*—Birch, Stewart, Kolasch & Birch, LLP.

(57) ABSTRACT

An antenna apparatus arranged in accordance with the invention has a plurality of element antennas 1 arranged on a plurality of concentric circles 2 assumed to exist on a plane and differs in radius from each other, and forms a beam in a direction inclined by $\theta_0$ at the maximum from a direction perpendicular to the plane. If the radius of the n-th concentric circle 2 from the inner side is $a_n$; the number of element antennas 1 arranged on the n-th concentric circle 2 from the inner side is $M_n$, and the number of waves is k, the number $M_n$ of element antennas 1 arranged on each concentric circle 2 is determined so as to satisfy the following equation:

$$M_n+0.8\cdot M_n^{1/3}>k\cdot a_n\cdot(1+\sin\theta_0)$$

Also, the element antennas 1 are arranged on each concentric circle 2 by being generally equally spaced apart from each other in the circumferential direction of the concentric circle.

8 Claims, 7 Drawing Sheets

(b)

(a)

(b)

(a)

(b)

(a)

(b)

(a)

(b)

ANTENNA

This application is the national phase under 35 U.S.C. § 371 of PCT International Application No. PCT/JP01/01463 which has an International filing date of Feb. 27, 2001, which designated the United States of America.

TECHNICAL FIELD

This invention relates to an antenna apparatus, and more particularly, to an antenna apparatus, for example, in the antenna apparatuses used for telecommunications or a radar, in which beam formation is performed by arranging a plurality of element antennas.

BACKGROUND ART

FIG. 7 is a diagram showing the construction of a conventional antenna apparatus, e.g., one described in Japanese Patent Application Laid-open No. Hei 7-288417. In the figure, reference numeral 1 designates a plurality of element antennas arranged on a plane and reference numeral 2 designates concentric circles (or concentric circumferences) along which the element antennas are arranged. A feeder means (not shown), which adjusts the excitation amplitude and the excitation phase, is connected to each element antenna 1.

The operation will next be described. This antenna apparatus can have desired radiation characteristics by adjusting the excitation amplitude and the excitation phase with respect to each element antenna 1 by the feeder means.

The conventional antenna apparatus thus arranged has a problem in that if the spacing between the element antennas 1 in a circumferential direction along each concentric circle 2 is increased, high-level sidelobes are generated and the desired radiation characteristic cannot be obtained.

The element antenna spacing may be reduced to avoid such sidelobes. However, if the spacing is reduced to a value smaller than necessary, the number of element antennas is increased and an increase in cost results. Moreover, a problem arises in that mutual coupling between the element antennas is increased and it is therefore difficult to obtain the desired radiation characteristic.

This invention has been achieved to solve the problems described above, and an object of this invention is to provide a low-cost antenna apparatus having the minimum number of element antennas required to suppress unnecessary sidelobe levels.

DISCLOSURE OF INVENTION

The present invention relates to an antenna apparatus in which a plurality of element antennas are arranged on a plurality of concentric circles assumed to exist on a plane and differing in radius from each other, and which forms a beam in a direction inclined by $\theta_0$ at the maximum from a direction perpendicular to the plane, said antenna apparatus being characterized in that if the radius of the nth concentric circle from the inner side is $a_n$; the number of element antennas arranged on the nth concentric circle from the inner side is $M_n$; and the number of waves is k, the number $M_n$, of element antennas arranged on each concentric circle is determined so as to satisfy the following equation:

$$M_n+0.81\cdot M_n^{1/3}>k\cdot a_n\cdot(1+\sin\theta_0)$$

and in that the element antennas are arranged on each concentric circle by being generally equally spaced apart from each other in the circumferential direction of the concentric circle.

Further, in the apparatus, it is configured such that if the radius of the innermost concentric circle is $a_1$; the number of element antennas existing on the circumference thereof is $M_1$; the radius of the n-th concentric circle form the inner side is $na_1$; and the number of element antennas existing on the circumference thereof is $nM_1$; the number $M_1$ of element antennas existing on the innermost concentric circle is determined so as to satisfy the following equation:

$$M_1+0.81\cdot(M_1/n^2)^{1/3}>k\cdot a_1\cdot(1+\sin\theta_0)$$

Further, in the apparatus, it is configured such that the number $M_n$ of element antennas arranged on the nth concentric circle from the inner side is set to an odd number.

Further, in the apparatus, it is configured such that the number $M_1$ of element antennas arranged on the innermost concentric circle is set to an odd number.

Further, in the apparatus, it is configured such that with respect to an imaginary straight line passing through the center of the plurality of concentric circles, the element antennas on the concentric circles are arranged so as not to be aligned on any straight line parallel to the imaginary straight line.

Further, in the apparatus, it is configured such that the element antennas arrangement start position on each concentric circle has an angular displacement through an randomly selected angle of $\Delta_n$ from a straight line passing through the center of the concentric circles.

Further, in the apparatus, it is configured such that with respect to an imaginary straight line passing through the center of the plurality of concentric circles, the number of element antennas existing on one side of the straight line and the number of element antennas existing on the other side of the straight line are made approximately equal to each other.

Further, in the apparatus, it is configured such that feed to the plurality of element antennas is performed by means of a radial waveguide.

BEST MODE FOR CARRYING OUT THE INVENTION

Embodiment 1.

Figure 1:
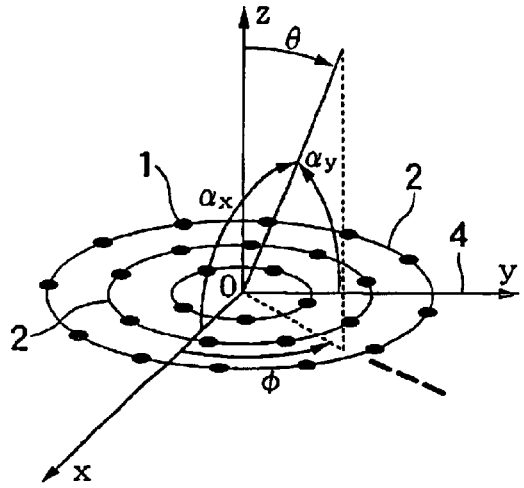
FIG. 1 are diagrams showing an arrangement of element antennas of an antenna apparatus in accordance with Embodiment 1 of the present invention.
Figure 1:
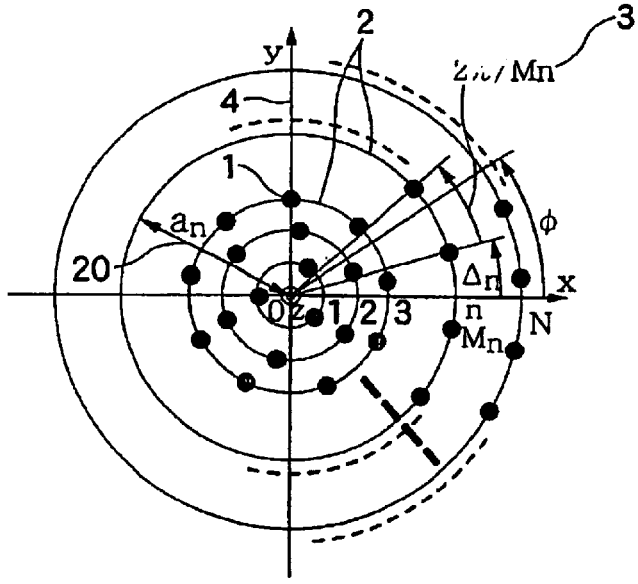
Figure 2:
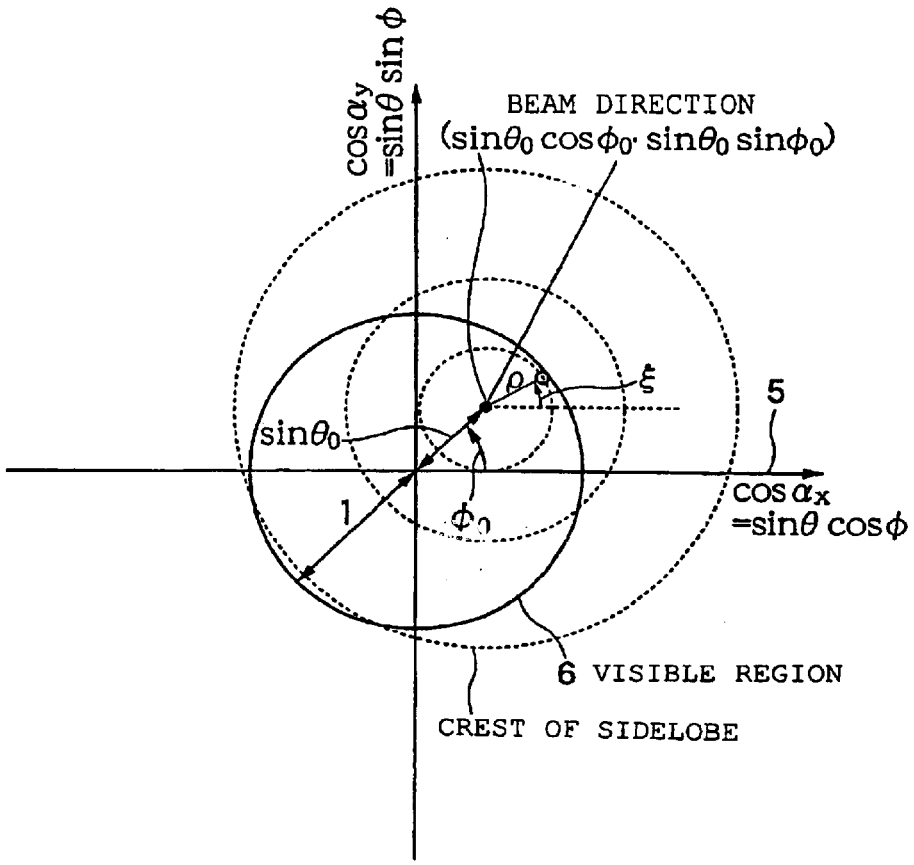
FIG. 2 is a diagram for explaining, in a wave number space, radiation characteristics of the antenna apparatus shown in FIG. 1.

An operation of an array antenna having element antennas arranged on concentric circles will first be described to clarify effects of the present invention. FIG. 1 are diagrams showing an arrangement of element antennas of an antenna apparatus in accordance with Embodiment 1 of the present invention. FIG. 1(*a*) is a perspective view, and FIG. 1(*b*) is a plan view. In FIG. 1, reference numeral 1 designates element antennas arranged on a plane are indicated, reference numeral 2 designates concentric circles (or concentric circumferences) along which the element antennas are arranged, reference numeral 3 designates an element antenna spacing along the concentric circumference direction, and reference numeral 4 designates a coordinate system. FIG. 2 is a diagram for explaining radiation characteristics of the above-mentioned antenna apparatus in a wave number space. In FIG. 2, a wave number space coordinate system is indicated by 5 and a visible region is indicated by 6. Also in this antenna apparatus, a feeder means (not shown) which adjusts the excitation amplitude and the excitation phase with respect to each element antenna 1 is connected, likewise in the above-described conventional antenna apparatus.

The structure of this antenna apparatus will next be described. This antenna apparatus has a plurality of element antennas 1 on each of a plurality of imaginary concentric circles 2 on the x-y plane of the coordinate system 4. It is assumed that: the concentric circles 2 are numbered n ($1 \leqq n \leqq N$) in order from the inner side, as shown in FIG. 1(*b*); the total number of concentric circles 2 is N; the radius of the nth concentric circle 2 is $a_n$; the number of element antennas on the n-th concentric circle 2 is $M_n$; in one concentric circle 2, the element antennas 1 are arrayed by being equally spaced apart from each other along the circumferential direction of the concentric circle 2; all the excitation amplitudes for the element antennas 1 on the n-th concentric circle 2 are assumed to be equal to each other and are represented by $E_n$; and, on the n-th concentric circle 2, the element antennas 1 are arranged from the position having an angular displacement through an angle of $\Delta_n$ from the x-axis of the coordinate system 4. This angle $\Delta_n$ is randomly selected for a reason described below in detail with respect to Embodiment 5.

The operation of this antenna apparatus will next be described. This antenna apparatus can have a desired radiation characteristic if the above-described element antennas are given predetermined excitation amplitudes and excitation phases. With respect to this embodiment, a case will be considered in which excitation phases are given such that the phases of radiation from each of the element antennas 1 in a predetermined direction ($\theta_0$, $\phi_0$) are set to be in-phase. If the angle $\phi$ on the x-y plane of the $m_n$-th element antenna 2 on the n-th concentric circle 2 from the x-axis is $\phi'_{mn}$ and the number of waves in the free space is k, then a radiation characteristic $f(\theta, \phi)$ of the antenna is expressed by the following equation:

$$f(\theta, \phi) = \frac{1}{E_{all}} \sum_{n=1}^{N} E_n \sum_{m_n=1}^{M_n} \exp[j \cdot k \cdot a_n \{(\sin\theta\cos\phi\cos\phi'_{m_n} + \sin\theta\sin\phi\sin\phi'_{m_n}) - \sin\theta_0\cos\phi_0\cos\phi'_{m_n} + \sin\phi_0\sin\phi_0\sin\phi'_{m_n})\}] \quad (1)$$

$$\text{wherein } E_{all} = \sum_{n=1}^{n} E_n \cdot M_n$$

If the above equation (1) is expressed in a wave number space having $\sin\theta\cos\phi$ and $\sin\theta\sin\phi$ as orthogonal axes, the following equation (2) is formed. In the following equation, $J_n$ is an n-order Bessel function of the first kind.

$$f(\theta, \phi) = \frac{1}{E_{all}} \sum_{n=1}^{N} \left[ E_n \cdot M_n \cdot \left\{ \underline{J_0(k \cdot a_n \cdot \rho)} + 2 \underline{\underline{\sum_{q=1}^{\infty} j^{M_n \cdot q} \cdot J_{M_n \cdot q}(k \cdot a_n \cdot \rho) \cdot \cos(M_n \cdot q \cdot (\xi - \Delta_n))}} \right\} \right] \quad (2)$$

$$\text{wherein } \rho = \sqrt{(\sin\theta\cos\phi - \sin\theta_0\cos\phi_0)^2 - (\sin\theta\sin\phi - \sin\theta_0\sin\phi_0)^2}$$

$$\cos\xi = \frac{(\sin\theta\cos\phi - \sin\theta_0\cos\phi_0)}{\sqrt{(\sin\theta\cos\phi - \sin\theta_0\cos\phi_0)^2 - (\sin\theta\sin\phi - \sin\theta_0\sin\phi_0)^2}}$$

It can be understood from the above equation (2) that the level of the radiation characteristic in the wave number space changes in sine wave on the circumference having a constant distance $\rho$ from the beam direction ($\sin\theta_0\cos\phi_0$, $\sin\theta_0\sin\phi_0$). FIG. 2 shows the state thereof. In FIG. 2, the inside of the circumference at a distance of 1 from the origin of the wave number space coordinate system 5 is a radiation pattern appearing in the actual physical space (visible region 6). Further, it can be understood from the above equation (2) that the single-underlined part of equation (2) having the zero-order Bessel function of the first kind contributes to the main beam ($\rho$=0 position) and sidelobes ($\rho$>0 region), while the double-underlined part of equation (2) contributes only to sidelobes of $\rho$>0 because it is formed by the first- and higher-order Bessel functions of the first kind having no value at with respect to $\rho$=0. Therefore, sidelobes can be decreased if the value of the double-underlined part is sufficiently small in the visible region 6.

The first- and higher-order Bessel functions of the first kind $J_n(x)$ generally have extremely small values with respect to x=0 to n and change in sine form with respect to larger values of x. Therefore, if the term in which q=1 in the double-underlined part of equation (2) is sufficiently small in the visible region 6, the terms in which q>1 can be ignored and the entire double-underlined part becomes small. In the above-described antenna apparatus, when beam scanning from the apex (the z-axis in FIG. 1) to the maximum $\theta_0$ is performed, the maximum value of ρ in the visible region is $(1+\sin\phi_0)$. The first peak point of the Bessel function of the first kind $J_n(x)$ is expressed by $$x \approx n+0.81 \cdot n^{1/3}$$

Therefore, the number $M_n$ of element antennas on each concentric circle 2 is selected so as to satisfy the following equation (3) in order to make the double-underlined part of equation (2) sufficiently small.

$$M_n+0.81 \cdot M_n^{1/3} > k \cdot a_n \cdot (1+\sin\theta_0) \quad (3)$$

As described above, if the minimum of $M_n$ satisfying the above equation (3) is selected as the number of element antennas on each concentric circle 2, and if the element antennas are arranged by being generally equally spaced apart from each other, an antenna apparatus can be obtained which has a minimum number of element antennas, and in which sidelobes in visible region 6 can be suppressed, an increase of mutual coupling between element antennas can be prevented, and a desired radiation characteristic can be obtained. Thus the number of element antennas can be limited to the necessary minimum number to achieve a cost reduction effect.

Embodiment 2.

Embodiment 2 will be described with reference to FIG. 1. It is assumed that the differences between the radii $a_n$ of the concentric circles 2 in Embodiment 1 are equal to each other; $a_n=n \cdot a_1$; and, if the number of element antennas on the first concentric circle 2 from the inner side is $M_1$, the number of element antennas on the n-th concentric circle 2 is $M_n=n \cdot M_1$. In this case, the element antenna spacing on each concentric circle 2 along the circumferential direction of the concentric circle 2 is $2\pi a_1/M_1$.

Under the above conditions, the following equation is obtained from equation (3) in Embodiment 1 shown above:

$$M_1+0.81 \cdot (M_1/n^2)^{1/3} > k \cdot a_1 \cdot (1+\sin\theta_0) \quad (4)$$

If $M_1$ is selected so as to satisfy the above equation (4), an antenna apparatus can be formed which has a minimum number of element antennas, and in which a desired radiation characteristic can be obtained by suppressing sidelobes in visible region 6, and a cost reduction effect can be achieved, as in Embodiment 1.

Further, since in the antenna apparatus of this embodiment the element antenna spacing is set uniform in the radial direction and in the circumferential direction, the element antennas are arranged generally uniformly at the antenna aperture. Therefore the aperture efficiency can be improved and a high-gain antenna can be formed.

Embodiment 3.

Figure 3:
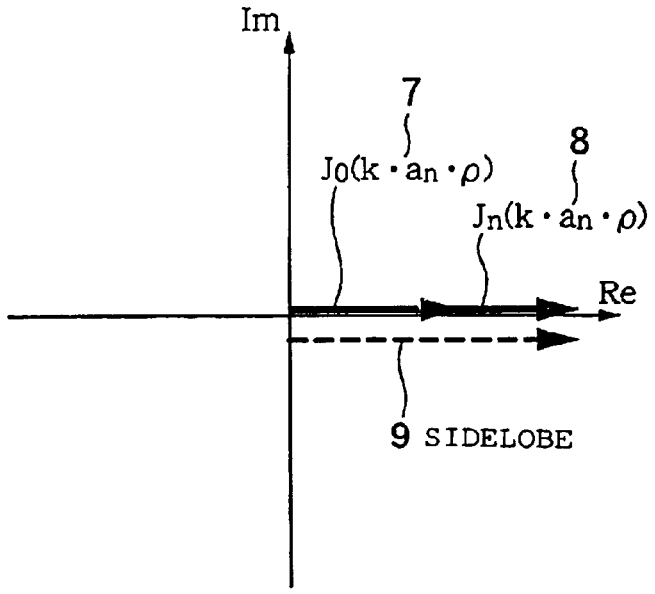
FIG. 3 are diagrams showing a vector space in which addition of a single-underlined term and a double-underlined term of an equation (2) is expressed.
Figure 3:
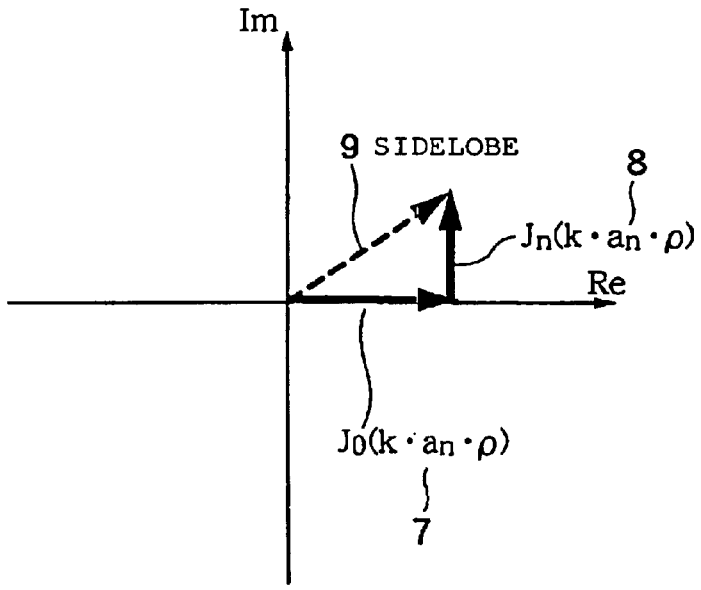

Embodiment 3 will be described with reference to the above equation (2) and FIG. 3. FIG. 3 show a vector space with respect to one of the above-described concentric circles 2, in which addition of the single-underlined term and the double-underlined term in equation (2) when a predetermined $(k \cdot a_n \cdot \rho)$ is given is expressed. In the figures, a vector representing the single-underlined term is indicated by 7, a vector representing one double-underlined term is indicated by 8, and a vector produced by addition of the vectors representing the two terms (i.e., a sidelobe) is indicated by 9.

This embodiment is characterized by setting the number of element antennas on each concentric circle 2 to an odd number in the array shown in FIG. 1. The behavior of a sidelobe in the case of setting to an odd number will be described below.

Of the terms in the double-underlined part of equation (2) contributing to sidelobes, the one appearing first in the visible region and having the largest amplitude is the term in which q=1. In Embodiments 1 and 2, the number of element antennas is selected so as to suppress this term. With respect to a wide angle, however, the rise of the peak of the term in which q=1 may be seen and the sidelobe is increased while the peak itself is not seen. To suppress this sidelobe, the number of element antennas on each concentric circle 2 may be set to an odd number.

The behavior of the radiation pattern formed by the element antennas 1 on the n-th concentric circle 2 at a predetermined $(k \cdot a_n \cdot \rho)$ corresponding to a wide angle will be discussed. The single-underlined term 7 in equation (2) is always a real number irrespective of the number of element antennas. On the other hand, the term 8 in which q=1 in the double-underlined part of equation (2) is a real number if $M_n$ is an even number, or an imaginary number if $M_n$ is an odd number. FIG. 3 shows the resultant 9 of the term 7 and the term 8. If $M_n$ is an even number, the two terms are in phase with each other and a large sidelobe 9 is therefore formed, as shown in FIG. 3(*a*). If $M_n$ is an odd number, the two terms are orthogonal to each other and the large sidelobe 9 is therefore smaller, as shown in FIG. 3(*b*). This can be said not only with respect to one concentric circle. The same phenomenon occurs with respect to a combination of a plurality of concentric circles 2. Thus, it is possible to achieve an effect in further reducing the sidelobe level by setting the number of element antennas on each concentric circle 2 to an odd number.

Embodiment 4.

Embodiment 4 is such that the number $M_1$ of element antennas on the first concentric circle 2 in the antenna apparatus of Embodiment 2 is set to an odd number. In the antenna apparatus of Embodiment 2, to realize a generally uniformly arranged state of the element antennas by equally spacing all the element antennas apart from each other, the radii of concentric circles 2 are set in the relationship $a_n=n \cdot a_1$ and the numbers of element antennas in the circumferential direction are set in the relationship $M_n=n \cdot M_1$. Therefore it is impossible to set the numbers of element antennas on all the concentric circles 2 to odd numbers, but it is possible to set the numbers of element antennas on the odd-numbered concentric circles, i.e., the first, third, fifth, and so on of the concentric circles, to odd numbers by setting $M_1$ to an odd number. Thus, it is possible to suppress sidelobes by the same effect as that in Embodiment 3.

Note that, if an even number is set as $M_1$, the numbers of element antennas on all the concentric circles 2 are even numbers and the sidelobe suppression effect of setting odd numbers of element antennas cannot be obtained. However, this method also has the effect of enabling a high-gain antenna apparatus to be formed because the element antennas are arranged generally uniformly at the antenna aperture so that the aperture efficiency is high as in Embodiment 2.

Embodiment 5.

Figure 4:
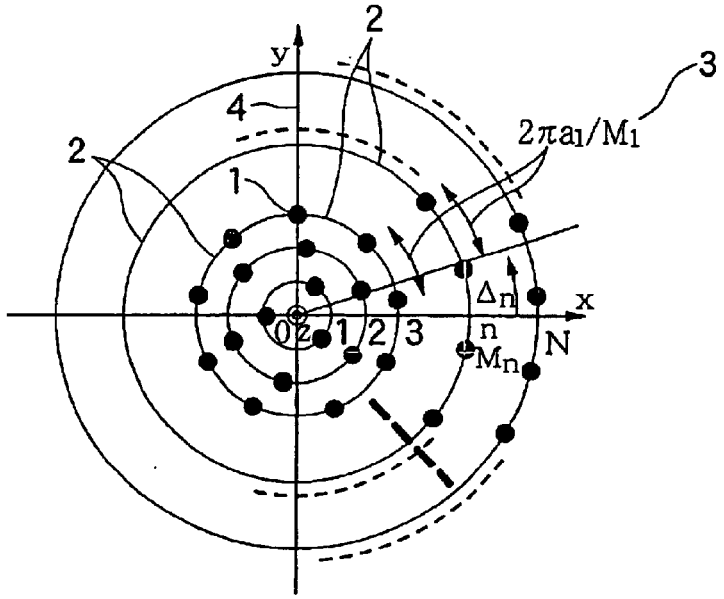
FIG. 4 are diagrams showing the arrangement of element antennas of an antenna apparatus in accordance with Embodiment 5 of the present invention, and a referential example for comparison therewith.
Figure 4:
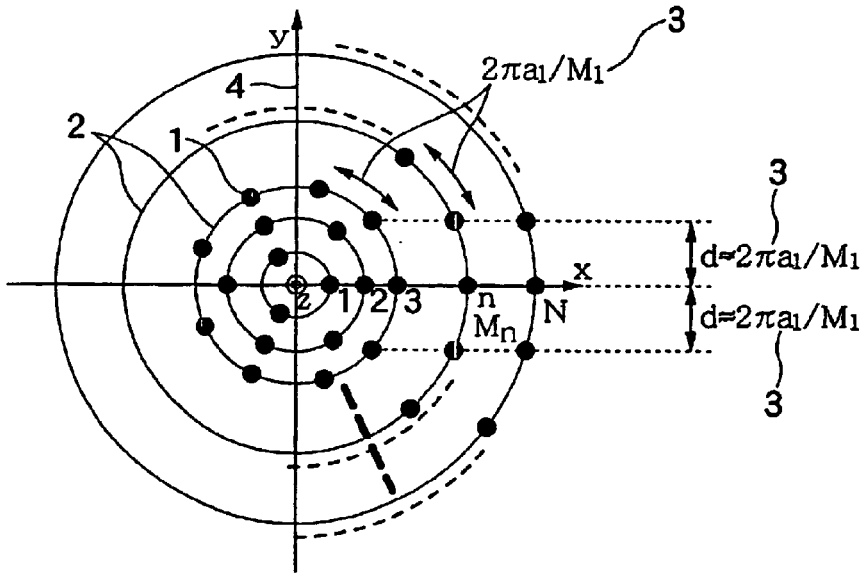

FIG. 4 show the arrangement of element antennas in an antenna apparatus in Embodiment 5. FIG. 4(*a*) shows this antenna apparatus in a case where the element antenna 1 arrangement start position on each concentric circle 2 is shifted by Δn from the x-axis, and FIG. 4(*b*) shows a referential example which is to be described in comparison with the arrangement of the present invention, and in which the element antenna 1 arrangement start positions on all the concentric circles 2 are set on the x-axis. In the figure, reference numeral 10 designates a gap d between element antennas 1 appearing in the vicinity of an antenna center due to setting of the element antenna 1 arrangement start positions on the same straight line. The other numbers are the same as those in the above-described arrangement.

This embodiment comprises an example of the array described with respect to Embodiment 2 or 4, in which all the elements are arranged with the same circumferential spacing. FIG. 4(*b*) shows a case in which the arrangement of the element antennas on each concentric circle 2 is started from the x-axis. In this case, in correspondence with those larger in radius in the concentric circles 2, element antennas 1 are uniformly arranged above and below the x-axis along straight lines spaced apart from the x-axis by a distance 10 of $$d \approx 2\pi a_1 / M_1,$$

as shown in FIG. 4(*b*). Thus the groups of element antennas 1 are seen as if they are distributed above and below the x-axis by a distance of 2d. If such a regular spacing occurs, a problem of occurrence of a larger sidelobe arises.

To solve this, according to the present invention, the element antenna 1 arrangement start position on each concentric circle 2 is shifted by $\Delta_n$ from the x-axis and $\Delta_n$, is randomly selected, as shown in FIG. 4(*a*). This method has the effect of limiting the above-mentioned rise of a sidelobe by preventing occurrence of a regular gap resulting from arrangement of element antennas 1 on straight lines.

Embodiment 6.

Figure 5:
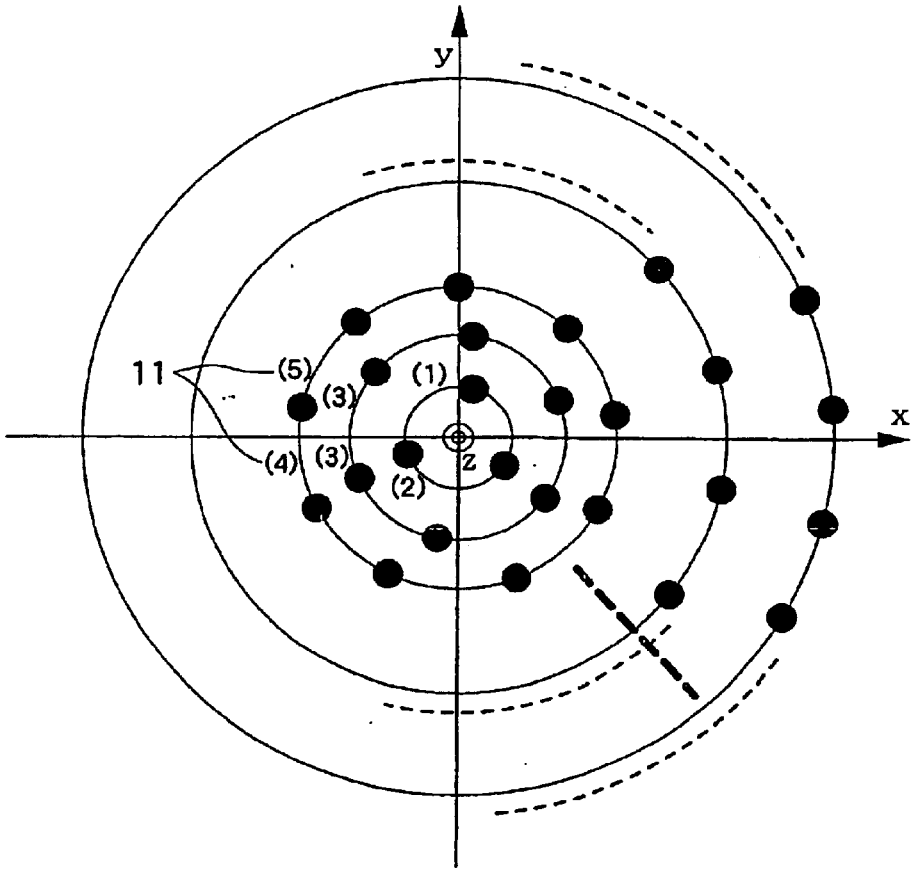
FIG. 5 is a diagram showing the arrangement of element antennas of an antenna apparatus in accordance with Embodiment 6 of the present invention.

FIG. 5 shows the arrangement of element antennas in Embodiment 6. In the figure, each of numerals inside parentheses indicated by 11 represents the numbers of element antennas existing on the portions of the corresponding concentric circle 2 above and below the x-axis. The other numbers are the same as those in the above-described arrangement.

This embodiment comprises an example of the array described with respect to Embodiment 4, in which all the elements are arranged with the same circumferential spacing, and in which the numbers of element antennas on the odd-numbered concentric circles 2 from the inner side are odd numbers. An object of the present invention is to obtain a mono-pulse-difference pattern through a radiation characteristic. For example, in a case where a difference pattern is formed as a y-z plane pattern shown in FIG. 5, it is necessary that the numbers of element antennas arranged above and below the x-axis be approximately equal to each other. On each concentric circle 2, the circumferential element spacing is uniform. Therefore, on each of the concentric circles 2 with the even numbers of element antennas, the numbers of element antennas above and below the x-axis are always equal to each other. However, on each of the concentric circles 2 with the odd numbers of element antennas, the number of element antennas above or below the x-axis is larger by one. Therefore, the concentric circles 2 with the larger numbers of element antennas above the x-axis and the concentric circles 2 with the larger numbers of element antennas below the x-axis are alternately combined from the inner side, thus making it possible to make the numbers of element antennas above and below the x-axis in the entire antenna apparatus approximately equal to each other, as shown in FIG. 5. By this method, an antenna apparatus capable of forming a mono-pulse-difference pattern is obtained.

While Embodiment 4 has been referred to by way of example, the same method may be applied to the other embodiments described above without losing the effect achieved in each embodiment.

In a case where a mono-pulse-difference pattern is to be formed on the x-z plane as well as on the y-z plane, the above-described method may be used so that the numbers of element antennas are equalized between the upper and lower sides of the x-axis and between the left-hand and right-hand sides of the y-axis.

Embodiment 7.

Figure 6:
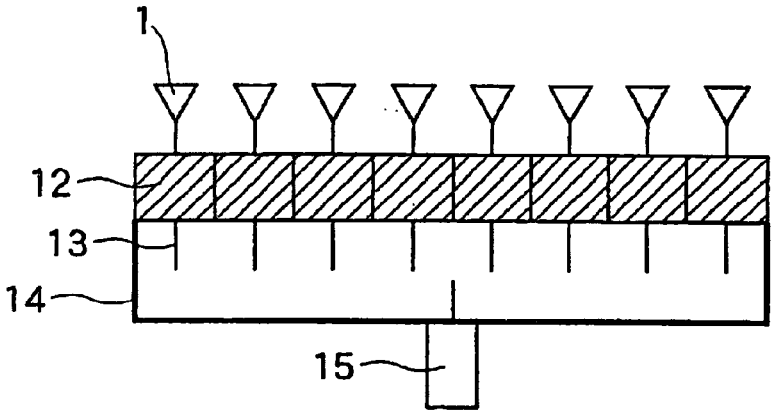
FIG. 6 are diagrams showing a feeder structure in an antenna apparatus in accordance with Embodiment 7 of the present invention.
Figure 6:
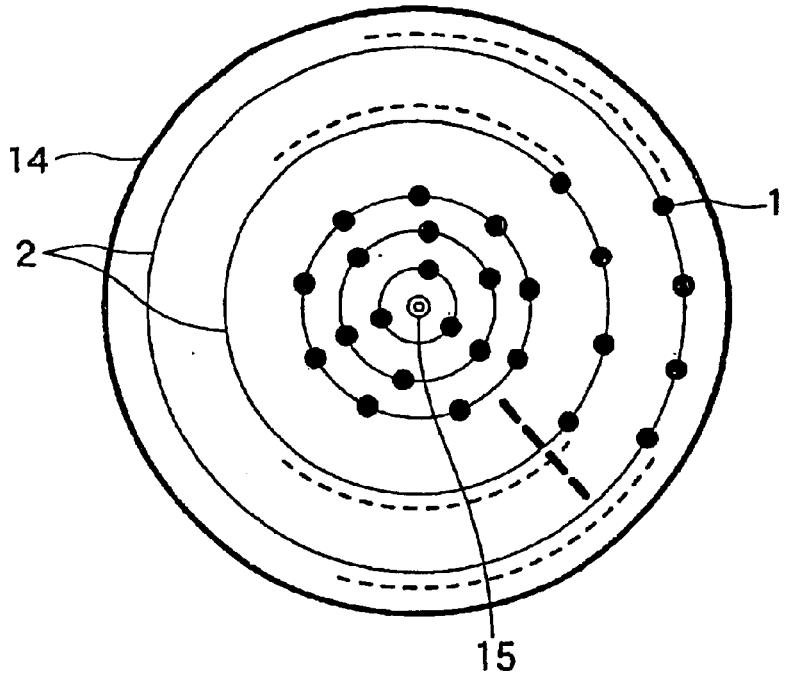
Figure 7:
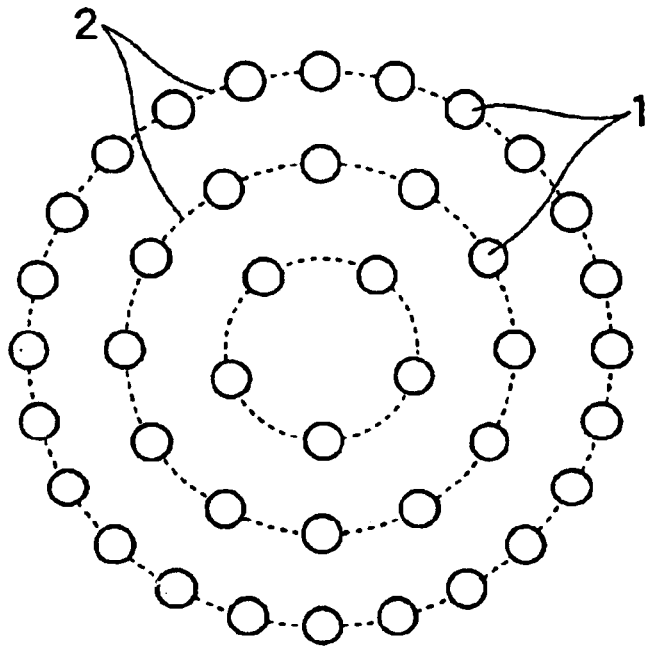
FIG. 7 is a diagram showing the arrangement of element antennas of a conventional antenna apparatus.

FIG. 6 show an antenna apparatus in accordance with Embodiment 7. FIG. 6(*a*) is a cross-sectional view, and FIG. 6(*b*) is a top view. In the figures, reference numeral 12 designates a module connected to each of element antennas 1 and having an amplifier and a phase shifter; reference numeral 13 designates a probe for electrical coupling between the module 12 and a radial waveguide; reference numeral 14 designates the radial waveguide; and reference numeral 15 designates a coaxial probe for feed to the radial waveguide.

The operation of this embodiment will be described with respect to a transmitting antenna. An electric wave radiated from the coaxial probe 15 propagates through the interior of the radial waveguide 14 while forming a cylindrical wave front having a center corresponding to the coaxial probe 15. This electric wave is coupled at some midpoint to the module 12 through the probe 13. The module 12 performs amplification and phase adjustment on the coupled electric wave in accordance with the desired amplitude and phase, and excites the element antenna 1. A pattern of radiation from the antenna apparatus is formed by combining electric waves emitted from the element antennas 1. In the case of a receiving antenna, electric waves traveled in directions opposite to that described above.

In feeding the antenna by means of the radial waveguide 14, it is important to avoid disturbance of the cylindrical wave front. If scattering members such as probes exist randomly in the radial waveguide 14, the wave front is disturbed so that feed to each module 12 with a fixed amplitude and phase cannot be performed and it is difficult to the obtain a desired radiation characteristic. In this embodiment, some of the element antenna arrays shown in the above-described embodiments is used and, accordingly, the probes 13 are arrayed on concentric circles in the radial waveguide 14. That is, even if scattered waves are generated by the probes 13, the above-described cylindrical wave front is generally maintained because of the symmetry thereof, thus obtaining the desired radiation characteristic.

In this embodiment, since feed to each module 12 can be performed by means of the radial waveguide 14, there is no need for a feed circuit network of a complicated structure using a combination of a plurality of distributors, which is ordinarily used for antenna array feeding. That is, the feeder structure is simplified to achieve a cost reduction effect.

INDUSTRIAL APPLICABILITY

As described above, the antenna apparatus in accordance with the present invention has a plurality of element antennas arranged on a plurality of concentric circles assumed to exist on a plane and differs in radius from each other, and performs a beam-forming in a direction inclined by $\theta_0$ at the maximum from a direction perpendicular to the plane. If the radius of the n-th concentric circle from the inner side is $a_n$; the number of element antennas arranged on the n-th concentric circle from the inner side is $M_n$; and the number of waves is k, the number $M_n$ of element antennas arranged on each concentric circle is determined so as to satisfy the following equation:

$$M_n+0.81\cdot M_n^{1/3}>k\cdot a_n\cdot(1+\sin\theta_0)$$

Also, it is formed such that the element antennas are arranged on each concentric circle by being generally equally spaced apart from each other in the circumferential direction of the concentric circle. Therefore it is possible to achieve a cost reduction effect and to obtain a desired radiation characteristic by selecting the minimum number of element antennas required to reduce the occurrence of sidelobes.

Also, if the radius of the innermost concentric circle is $a_1$; the number of element antennas existing on the circumference thereof is $M_1$; the radius of the n-th concentric circle from the inner side is $na_1$; and the number of element antennas existing on the circumference thereof is $nM_1$; the number $M_1$ of element antennas existing on the innermost concentric circle is determined so as to satisfy the following equation:

$$M_1+0.81\cdot(M_1/n^2)^{1/3}>k\cdot a_1\cdot(1+\sin\theta_0)$$

The element antenna spacing is thereby made uniform in each of the radial and circumferential directions, so that the element antennas are arranged generally uniformly at the antenna aperture, the aperture efficiency is improved, and thus the gain can be increased.

Also, the number $M_n$ of element antennas arranged on the n-th concentric circle from the inner side is set to an odd number. The sidelobe level can be limited to a smaller value thereby.

Also, the number $M_1$ of element antennas arranged on the innermost concentric circle is set to an odd number. The numbers of element antennas on the odd-numbered concentric circles, i.e., the first, third, fifth, and so on of the concentric circles, can be set to odd numbers thereby, so that the sidelobe level can be limited to a smaller value.

Also, with respect to an imaginary straight line passing through the center of the plurality of concentric circles, the element antennas on the concentric circles are arranged so as not to be aligned on any straight line parallel to the imaginary straight line, thus preventing occurrence of a regular gap resulting from arrangement of element antennas on a straight line to limit the rise of a sidelobe.

Also, the element antennas arrangement start position on each concentric circle has an angular displacement through an randomly selected angle of $\Delta_n$ from a straight line passing through the center of the concentric circles, thus preventing occurrence of a regular gap resulting from arrangement of element antennas on a straight line to limit the rise of a sidelobe.

Also, with respect to an imaginary straight line passing through the center of the plurality of concentric circles, the number of element antennas existing on one side of the straight line and the number of element antennas existing on the other side of the straight line are made approximately equal to each other. Thus, the numbers of element antennas on opposite sides of a straight line can be equalized to obtain a mono-pulse-difference pattern through a radiation characteristic.

Also, feed to the plurality of element antennas is performed by means of a radial waveguide. Therefore there is no need for a feed circuit network of a complicated structure ordinarily used, and it is possible to achieve a cost reduction effect by simplifying the feeder structure.

What is claimed is:

1. An antenna apparatus in which a plurality of element antennas are arranged on a plurality of concentric circles assumed to exist on a plane and differs in radius from each other, and which performs a beam-forming in a direction inclined by $\theta_0$ at the maximum from a direction perpendicular to the plane, said antenna apparatus being characterized in that if the radius of the n-th concentric circle from the inner side is $a_n$; the number of element antennas arranged on the n-th concentric circle from the inner side is $M_n$; and the number of waves is k, the number $M_r$ of element antennas arranged on each concentric circle is determined so as to satisfy the following equation:

$$M_n+0.8\cdot M_n^{1/3}>k\cdot a_n\cdot(1+\sin\theta_0)$$

and in that the element antennas are arranged on each concentric circle by being generally equally spaced apart from each other in the circumferential direction of the concentric circle.

2. An antenna apparatus according to claim 1, characterized in that if the radius of the innermost concentric circle is $a_1$; the number of element antennas existing on the circumference thereof is $M_1$; the radius of the n-th concentric circle from the inner side is $na_1$; and the number of element antennas existing on the circumference thereof is $nM_1$; the number $M_1$ of element antennas existing on the innermost concentric circle is determined so as to satisfy the following equation:

$$M_1+0.81\cdot(M_1/n^2)^{1/3}>k\cdot a_1\cdot(1+\sin\theta_0)$$

3. An antenna apparatus according to claim 1, characterized in that the number $M_n$ of element antennas arranged on the n-th concentric circle from the inner side is set to an odd number.

4. An antenna apparatus according to claim 2, characterized in that the number $M_1$ of element antennas arranged on the innermost concentric circle is set to an odd number.

5. An antenna apparatus according to claim 1, characterized in that with respect to an imaginary straight line passing through the center of the plurality of concentric circles, the element antennas on the concentric circles are arranged so as not to be aligned on any straight line parallel to the imaginary straight line.

6. An antenna apparatus according to claim 5, characterized in that the element antennas arrangement start position on each concentric circle has an angular displacement through an randomly selected angle of $\Delta_n$ from said straight line passing through the center of the concentric circles.

7. An antenna apparatus according to claim 1, characterized in that with respect to an imaginary straight line passing through the center of the plurality of concentric circles, the number of element antennas existing on one side of the straight line and the number of element antennas existing on the other side of the straight line are made approximately equal to each other.

8. An antenna apparatus according to claim 1, characterized in that feed to the plurality of element antennas is performed by means of a radial waveguide.

* * * * *